US008302536B1

(12) United States Patent
Meinzinger

(10) Patent No.: US 8,302,536 B1
(45) Date of Patent: Nov. 6, 2012

(54) RAIL SYSTEM FOR A POWERED PALLET CONVEYOR

(75) Inventor: Bruno Meinzinger, Munich (DE)

(73) Assignee: ROFA Rosenheimer Forderanlagen GmbH, Kolbermoor (DE)

( * ) Notice: Subject to any disclaimer, the term of this patent is extended or adjusted under 35 U.S.C. 154(b) by 0 days.

(21) Appl. No.: 13/529,436

(22) Filed: Jun. 21, 2012

Related U.S. Application Data

(63) Continuation-in-part of application No. 12/495,761, filed on Jun. 30, 2009, now abandoned.

(30) Foreign Application Priority Data

Jul. 7, 2008 (EP) ..... 08012241

(51) Int. Cl.
*B61B 3/00* (2006.01)

(52) U.S. Cl. ..... 104/102; 104/96; 104/130.06; 104/48; 104/130.01

(58) Field of Classification Search ..... 246/415 R, 246/419, 430, 257, 262; 104/96, 99, 102, 104/130.01, 130.06
See application file for complete search history.

(56) References Cited

U.S. PATENT DOCUMENTS

| | | | | | |
|---|---|---|---|---|---|
| 2,138,962 | A * | 12/1938 | Forker, Jr. | 104/102 |
| 2,996,017 | A * | 8/1961 | Gorjanc et al. | 104/102 |
| 3,356,039 | A * | 12/1967 | Fonden et al. | 104/130.01 |
| 3,356,040 | A * | 12/1967 | Fonden | 104/130.01 |
| 4,109,584 | A * | 8/1978 | Mihirogi | 104/130.06 |
| 4,920,891 | A * | 5/1990 | Loomer | 104/102 |
| 5,154,123 | A * | 10/1992 | Loomer | 104/102 |
| 5,193,767 | A * | 3/1993 | Mihirogi | 246/418 |
| 5,247,890 | A * | 9/1993 | Mihirogi | 104/130.11 |
| 5,857,413 | A * | 1/1999 | Ward | 104/48 |
| 6,389,981 | B1 * | 5/2002 | Strothmann et al. | 104/48 |
| 2010/0000440 | A1 * | 1/2010 | Meinzinger | 104/102 |
| 2010/0050899 | A1 * | 3/2010 | Tabler | 104/96 |
| 2010/0147183 | A1 * | 6/2010 | Weissbrodt | 104/307 |

FOREIGN PATENT DOCUMENTS

| | | |
|---|---|---|
| DE | 1 943277 | 3/1971 |
| DE | 10 2005 030 367 A1 | 1/2007 |
| FR | 2 543 590 | 10/1984 |
| GB | 1 230 917 | 5/1971 |
| GB | 1 543 800 | 4/1979 |

OTHER PUBLICATIONS

European Search Report, dated Oct. 24, 2008, based on EP 08012241.9.

* cited by examiner

*Primary Examiner* — Jason C Smith
(74) *Attorney, Agent, or Firm* — Greenberg Traurig, LLP

(57) ABSTRACT

A rail system for a powered pallet conveyor, which comprises alternative pathways having an electric cable provided on at least one of n parallel rails defining a travel pathway, wherein n≧2, whereby the rail system includes a switch for switching between m alternative travel pathways, wherein m≧2, and allowing the vehicle to continuously move across the switch after switching. The switch comprises a first actuator for selectively positioning (m*n) rigid rail portions bridging the distance between rail ends at (i) n joining points where the n parallel rails of each of the m alternative travel pathways subject to switching converge, and (ii) (m*n) continuation points where each alternative pathway subject to switching diverges downstream from the joining points A second actuator selectively positions [m(n−1)] rigid rail portions bridging the distance between rail ends, where each alternative pathway is discontinued downstream from the corresponding continuation points.

8 Claims, 6 Drawing Sheets

RAIL SYSTEM FOR A POWERED PALLET CONVEYOR

RELATED APPLICATION

This application is a continuation-in-part and thus claims the benefit of and priority to U.S. patent application Ser. No. 12/495,761, filed Jun. 30, 2009 which claimed the benefit of and priority to European Patent Application No. EP 08 012 241.9, filed Jul. 7, 2008, the contents of which are incorporated by reference herein in its entirety.

BACKGROUND

1. Field

The present invention provides a rail system for a powered pallet conveyor. Moreover, the present invention provides a process for operating a switch of a rail system for a powered pallet conveyor. The present invention uses a switch means for switching between m alternative travel pathways, wherein m≧2, and allowing the vehicle to continuously move across the switch after switching.

2. Description of Related Art

Powered pallet conveyors are known. Powered pallet conveyors may be used for loading or unloading trucks and trailers with product on pallets or in containers. Powered pallet conveyors may comprise a vehicle and a rail system which defines pathways on which the vehicle may travel.

Conventional rail systems for a powered pallet conveyor may comprise switch means for allowing the vehicle to travel on alternative pathways. U.S. Pat. No. 4,498,399 discloses a free line switch arrangement for power-and-free trolley conveyors wherein the free line comprises two rails. Two other types of switch means have been considered, namely a quadro switch and a rotation switch.

A quadro switch, as shown in FIG. 5 of the drawings, is operated by first positioning the vehicle on the switch so that pivotable wheels of the vehicle are placed on rotatable rail portions. Subsequently, the rotatable rail portions are rotated independently so that the wheels of the vehicle are oriented along and guided to the new travel pathway.

A rotation switch, as shown in FIG. 6 of the drawings, is also operated by first positioning the vehicle on the switch so that the vehicle may be rotated as a whole on a rotatable turntable. Subsequently, the rotatable turntable is rotated so that the vehicle is oriented along and guided to the new travel pathway.

Both switch means are unsatisfactory in that the vehicle cannot travel continuously across the switching means without stopping. As a consequence, the presence of a switching means results in a limitation of the maximum speed by which the powered pallet conveyor is capable of completing a task. Limitations imposed by the switching means are even greater in cases when more than one switching is required per travel of the powered pallet conveyor.

Furthermore, conventional switching means have significant space requirements. Moreover, vehicles subjected to frequent acceleration/deceleration suffer from increased wear and earlier failure so that maintenance costs are high.

BRIEF SUMMARY OF THE INVENTION

It is the object of the present invention to provide a rail system for a powered pallet conveyor which allows the vehicle to travel continuously across the switching means without stopping while the switching means has reduced space requirements and does not subject vehicles to acceleration/deceleration during switching so that wear is reduced and early failure of the vehicle and high maintenance costs are avoided.

This problem is solved according to the present invention by a rail system for a powered pallet conveyor, which comprises alternative pathways for a vehicle traveling along an electric cable means provided on at least one of n parallel rail means defining a travel pathway, wherein n≧2, whereby the rail system is characterized by a switch means for switching between m alternative travel pathways, wherein m≧2, and allowing the vehicle to continuously move across the switch after switching, said switch means comprising (a) a first actuating means for selectively positioning (m*n) rigid rail portions bridging the distance between rail ends optionally holding cable ends at (i) n joining points where the n parallel rail means of each of the m alternative travel pathways subject to switching converge, and (ii) (m*n) continuation points where each alternative pathway subject to switching diverges downstream from the joining points, and (b) a second actuating means for selectively positioning [m(n−1)] rigid rail portions bridging the distance between rail ends optionally holding cable ends at crossing portions, where each alternative pathway subject to switching is discontinued downstream from the corresponding continuation points, whereby the positioning of a set of n rigid rail portions by the first actuating means and the positioning of (n−1) rigid rail portions by the second actuating means provides a travel pathway allowing the vehicle to continuously travel across the switch along the electric cable means provided on at least one of n parallel rail means defining the travel pathway.

Moreover, the present invention provides a process for operating a switch of a rail system for a powered pallet conveyor according to the invention, which comprises the steps of (a) selecting one of n alternative pathways;

(b) positioning n rigid rail portions for bridging the distance between (i) n joining points where the m alternative travel pathways subject to switching coincide, and (ii) n continuation points of the selected travel pathway downstream from the joining points, (c) positioning n−1 rigid rail portions for bridging the distance between rail ends optionally holding cable ends at crossing portions where each alternative pathway subject to switching is discontinued downstream from the corresponding continuation points, thereby providing the selected pathway allowing the vehicle to travel along an electric cable means provided along at least one of n parallel rail means defining the selected pathway.

DESCRIPTION OF THE PREFERRED EMBODIMENTS

Figure 1:
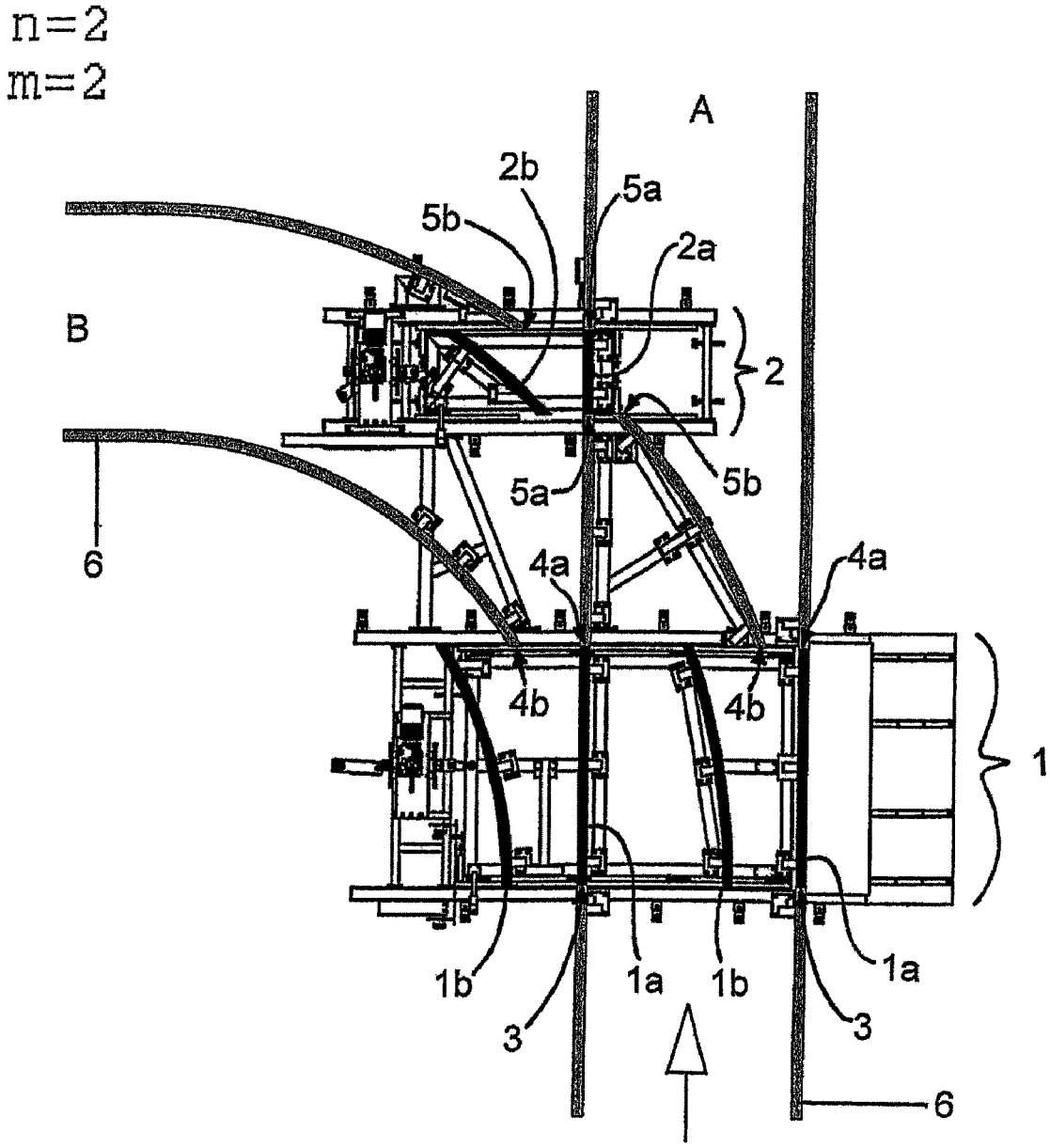
FIG. 1 shows a plan projection of a specific embodiment of the rail system, wherein the first and second actuating means are positioned so as to allow a vehicle to travel along an electric cable means provided along at least one of the parallel rail means defining the pathway A.

The present invention relates to a rail system for a powered pallet conveyor. The rail system comprises alternative pathways for a vehicle conveying a pallet along rails. A pathway in general means a connection between a starting point of a vehicle and a destination point of the vehicle which is provided by rails.

The powered pallet conveyor vehicle may be either loaded with a pallet or not. The vehicle conveys a pallet, either loaded or empty, on a pathway of the rail system. The pallet may be conveyed along the rail system with reduced frictional resistance by the use of wheels. The wheels may be attached to the vehicle by means of a bogey or bearing system and/or to the rails, so that they function as rollers or skatewheels. The wheels additionally serve to guide the vehicle along the rails and/or effect conveyance of the pallet.

The vehicle is powered by electrical potential energy, wherein an electric motor or motors convert the potential energy into movement of the vehicle in a particular direction along an alternative pathway of the powered pallet conveyor. The motor may be attached to the vehicle, wherein all or a selection of the wheels of said vehicle are driven by said motor. However, in the case where the conveyor comprises a rail system with wheels (rollers) attached to the rails, the motors may instead be attached to the rail system and power all or a selection of the wheels of the rails.

The rail system comprises alternative pathways for a vehicle traveling along an electric cable means. The electric cable means is provided on at least one of n parallel rail means defining a travel pathway, wherein $n \geqq 2$. Thus, a travel pathway is defined by two or more parallel rails, at least one of which carries an electric cable. When $n=2$, the travel pathway has two parallel rails, either one or both of the rails may carry an electric cable. The electric cable means is a cable capable of carrying electric current. The electric current may be used to either relay information or provide energy for powering the conveyor.

Thus, the electric cable comprises an electrically conductive wire, either in the form of a solid wire or woven strands. The electrically conductive wire comprises a metal selected from the list including copper, aluminum, gold and silver, either singly or in combination. The wire may be jacketed in an electrically insulative material such as polyethylene or polyvinylchloride. Further jacketing with mineral insulation, fiberglass armor, helical steel tape, aluminum armor, lead armor, woven bronze wire or woven steel wire may be employed to protect the cable. Alternatively, multiple wires, each optionally insulated, may be housed in the electrically insulative jacket.

The rails of the rail system comprise fixed (non-moveable) portions of rail, as well as the rigid rail portions of the first and second actuating means that may be selectively positioned so as to bridge the fixed portions of rail. The fixed portions of rail may be defined as those rails which are not rigid rail portions of the first or second actuating means. Selective positioning of the rigid rail portions of the first and second actuating means so as to comprise n parallel rail means defining a travel pathway, results in the rails of the rail system comprising a means for conveying and guiding the vehicle on a pathway of the rail system. The rails may additionally comprise at least part of the means for driving the vehicle, such as the rack of a rack and pinion. The rails may, furthermore, comprise a means for conducting electricity, such as an electrically conductive "third rail" system for electrifying the rail system.

Material suitable for the construction of the rails includes metals, alloys and polymers, used singly or in combination. The rails may comprise any of the metals selected from iron, copper, aluminum, tin, zinc, titanium, lead, manganese, chromium, vanadium and tungsten, either singly or in combination. In a further embodiment, the rails may comprise any of the alloys selected from steel, brass, bronze, Hastelloy, Electrum, Cupronickel and Duralumin. Optionally, the rails may comprise a polymer such as polyethylene, polystyrene, nylon and teflon, either singly or in combination. Particular combinations of these materials as composites, laminates, impregnates or coated materials may be used to provide rails with specific properties. For example, the rails may comprise a hybrid material such as steel laminated with aluminum which is not only capable of withstanding the stresses involved in conveying and guiding a vehicle along alternative pathways, but also is highly conductive. Alternatively, the rails may comprise iron or steel that is coated or laminated with a teflon so as to reduce friction and wear. Alternatively, the rails may comprise an electrically conductive material such as brass or a metal coated polymer, so as to themselves form an electric cable means along the travel pathway.

Each rail may have a profile which is a particular shape in cross section. In a preferred embodiment, the cross section may be an I- (or H-) shape, a T-shape, an L-shape, a U-shape or a rectangular shape. Variations on these profiles, such as the asymmetrical I-beam, flat-bottomed, bullhead, single parallel, parallel, grooved rail, flanged rail or bridge rail profiles may be employed, either singly or in combination. Most preferred is the embodiment in which the rail is an I-shape in cross section.

The rail means defining a travel pathway comprises parallel rails. Parallel rails are rails which are equidistant from one another (wherein the minimum distance between rails is essentially the same at any given position along the length of said rails). The rail system of the present invention comprises at least two alternative travel pathways each comprising at least two such parallel rail means subject to switching. Each rail means is comprised of at least two fixed sections, optionally joined to at least one moveable section (rigid rail portion) attached to an actuating means of the rail system.

Specifically, the rail system is characterized by a switch means. The switch means (a rail switch or rail points) is for switching between m alternative travel pathways, wherein $m \geqq 2$. When $m=2$, the rail system allows for the powered pallet to be conveyed along one of two alternative travel pathways downstream from a given position along the travel pathway subject to switching. Similarly, when $m=3$ or greater, one of three or more alternative travel pathways downstream of a given position along the travel pathway may be selected.

In a preferred embodiment, the rail system of the present invention may comprise a means for determining the position of a vehicle and communicating the position to a control means. Indeed, selection of a particular travel pathway and control of the rail system may be achieved manually or automatically. In the case where the rail system is controlled automatically, a programmable logic controller (PLC) may be used. The PLC electronically controls how individual sections of the rail system interact with the vehicle, and, hence, pallet, being conveyed. In particular, the PLC controls the positioning of the first and second actuating means in relation to the vehicle. Furthermore, the PLC controls the movement and positioning of the vehicle in relation to the rail system. The PLC is able to convey a vehicle through multiple rail systems of the invention. Moreover, the PLC is also able to convey multiple vehicles through either an individual rail system or multiple rail systems of the invention.

Electronic control of how individual sections of the rail system interact with the vehicle may be achieved by the use of rails which are capable of carrying electric current. The movement of the vehicle may also induce electric current. The electric current may be relayed along the rail and thereby provide information as to the location of the vehicle on the pathway. Alternatively, the rail may carry current for driving the actuating means and/or powering the vehicle.

Selection of a particular travel pathway is made prior to the vehicle reaching the alternative pathways. Specifically, the switch means for switching between m alternative travel pathways, wherein $m \geqq 2$, allows the vehicle to continuously move across the switch after switching. Accordingly, a travel pathway allowing the vehicle to continuously travel across the switch on at least one of n parallel rail means defining the travel pathway is provided in advance of said vehicle reaching said switch. With switching made downstream of the vehicle, the vehicle need neither stop nor slow down for selection to take place.

Figure 5:
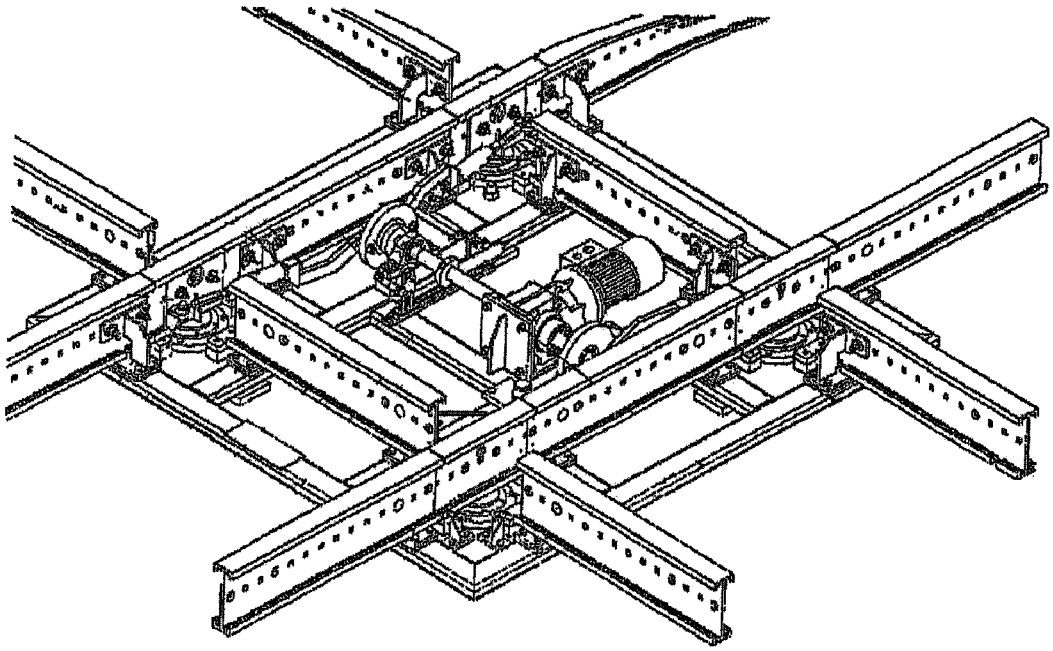
FIG. 5 (Prior Art)
FIG. 5 shows a quadro switch of the prior art.
Figure 6:
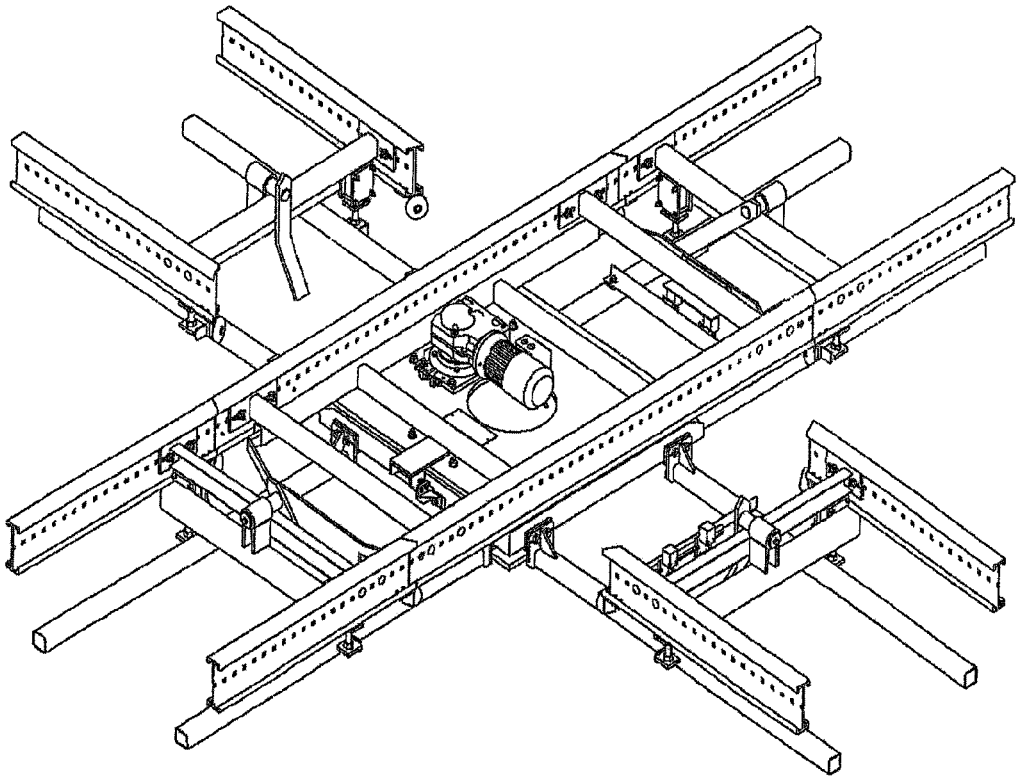
FIG. 6 (Prior Art)
FIG. 6 shows a rotation switch of the prior art.

In comparison, conventional switch processes such as that of the quadro switch or rotation switch of the prior art (FIGS. 5 and 6, respectively) require that the vehicle stops on the switch in order for selection of a pathway to occur, prior to then moving along that particular pathway. This translates to a cumulative loss of time, not just as a result of the time required for switching, but also that associated with the acceleration/deceleration process. Thus, the present invention provides a rail system which conserves time and therefore operates with greater efficiency of conveyance.

Furthermore, switch processes such as that of the quadro switch or rotation switch have the disadvantage that the forces involved in the acceleration/deceleration process lead to wear on the vehicle and rail means. Additionally, the forces involved in switching whilst the vehicle is stationary on the switch similarly may lead to increased wear on the switch mechanism. The present invention overcomes such disadvantages by dispensing with the need for stopping and starting the vehicle and by effecting the switching and, thus, provision of a travel pathway in advance of the vehicle reaching said switch. Accordingly, the lifetime of not only the rail system, but also the vehicle and rail means, as well as the associated means of driving the rail system and vehicle, is increased. This leads to a reduction in the costs and time associated with maintenance of the rail system.

Switch processes such as that of the quadro switch or rotation switch have considerable space requirements, particularly when it is intended for multiple pathways to be provided. Whilst the quadro switch would appear to be an exception in this regard, this system can only comprise travel pathways that intersect each other at a fixed angle, typically 90 degrees. In order to minimize the number of switch processes for a given travel pathway made, for example, of right-angle intersections, extended lengths of rail and hence increased amounts of space must be used. The space requirements associated with a rotation switch are less considerable, but an increase in the number of alternative travel pathways provided must, necessarily, be associated with an increase in the circumference, and hence diameter, of the rotatable turntable. In contrast, the rail system of the present invention is relatively compact and is capable of providing multiple travel pathways in a confined space.

This is achieved by said switch means comprising (a) a first actuating means and (b) a second actuating means. The first actuating means and second actuating means may be operated simultaneously or at different times. Furthermore, the first actuating means and second actuating means may be operated independently or non-independently of one another. In a preferred embodiment, the first actuating means is a shifting frame. In a further preferred embodiment, the second actuating means is a shifting frame. A shifting frame is a moveable framework upon which the rigid rail portions of the actuating means are firmly attached. The shifting frame may be shifted to align different sets of the rigid rail portions of the actuating means with fixed portions of the rail in order to allow the vehicle to travel across the actuating means.

The switch comprises a first actuating means for selectively positioning (m*n) rigid rail portions bridging the distance between rail ends optionally holding cable ends at (i) n joining points, and (ii) (m*n) continuation points.

The n joining points are where the n parallel rail means of each of the m alternative travel pathways subject to switching converge. The (m*n) continuation points are where each alternative pathway subject to switching diverges downstream from the joining points. Thus, the first actuating means selectively positions a subset of n of the (m*n) rigid rail portions of the first actuating means between the n joining points and a subset of n of the n continuation points, so as to link the fixed portions of rail with the rigid rail portions, thereby allowing the vehicle to travel across the first actuating means.

The switch additionally comprises a second actuating means for selectively positioning [m(n−1)] rigid rail portions bridging the distance between rail ends optionally holding cable ends at crossing portions where each alternative pathway subject to switching is discontinued downstream from the corresponding continuation points. Thus, the second actuating means selectively positions a subset of (n−1) of the [m(n−1)] rigid rail portions of the second actuating means between a subset of 2(n−1) of the rail ends at the crossing portions, so as to link the fixed portions of rail with the rigid rail portions, thereby allowing the vehicle to travel across the second actuating means.

The spatial relationship between the joining points, continuation points and crossing points is described as follows. The joining points are defined by the locations where the m alternative travel paths subject to switching coincide or diverge. The continuation points are located downstream from the joining points along the selected travel path. Specifically, the continuation points are located on the first actuating means at positions distant from the n joining points along each of the alternative travel pathways subject to switching. Furthermore, the crossing points are located at positions distant from the rigid rail portions of the first actuating means along each of the alternative travel pathways subject to switching. Thus, the positioning of a set of n rigid rail portions by the first actuating means and the positioning of (n−1) rigid rail portions by the second actuating means provides a travel pathway allowing the vehicle to continuously travel across the switch along the electric cable means provided on at least one of n parallel rail means defining the travel pathway.

The rail system of the present invention may be supported by a system of sleepers or cross ties, or mounted directly on the floor, on an elevated base, overhead or any of a combination of these. In a preferred embodiment, the pathways are mounted on the floor.

The rail system may comprise horizontal pathways, inclined pathways and/or vertical pathways. In the case where pathways deviate from the horizontal, it may be necessary to use a means for driving the vehicle, such as a rack and pinion, which can overcome the issues associated with operation on gradients.

A specific embodiment of the rail system of the present invention is shown in FIG. 1, wherein n=2 and m=2. The rail system comprises a first actuating means (1) for selectively positioning (m*n)=4 rigid rail portions (1*a*, 1*b*) bridging the distance between rail ends optionally holding cable ends at the n=2 joining points (3) and at the (m*n)=4 continuation points (4*a*, 4*b*). The rail system additionally comprises a second actuating means (2) for selectively positioning [m(n−1)]=2 rigid rail portions (2*a*, 2*b*) bridging distance between rail ends optionally holding cable ends at crossing portions (5*a*, 5*b*), where each alternative pathway subject to switching is discontinued downstream from the corresponding continuation points (3) and continuation points (4*b*) are not linked by the rigid rail portions (5*b*) and not linked by rigid rail portions (2*b*) of the second actuating means (2). Therefore a travel pathway allowing the vehicle to continuously travel across the switch along the electric cable means 100 (see FIG. 3) provided on at least one of the n parallel rail means (6) defining the travel pathway B is not provided in the setup shown in FIG. 1.

Figure 2:
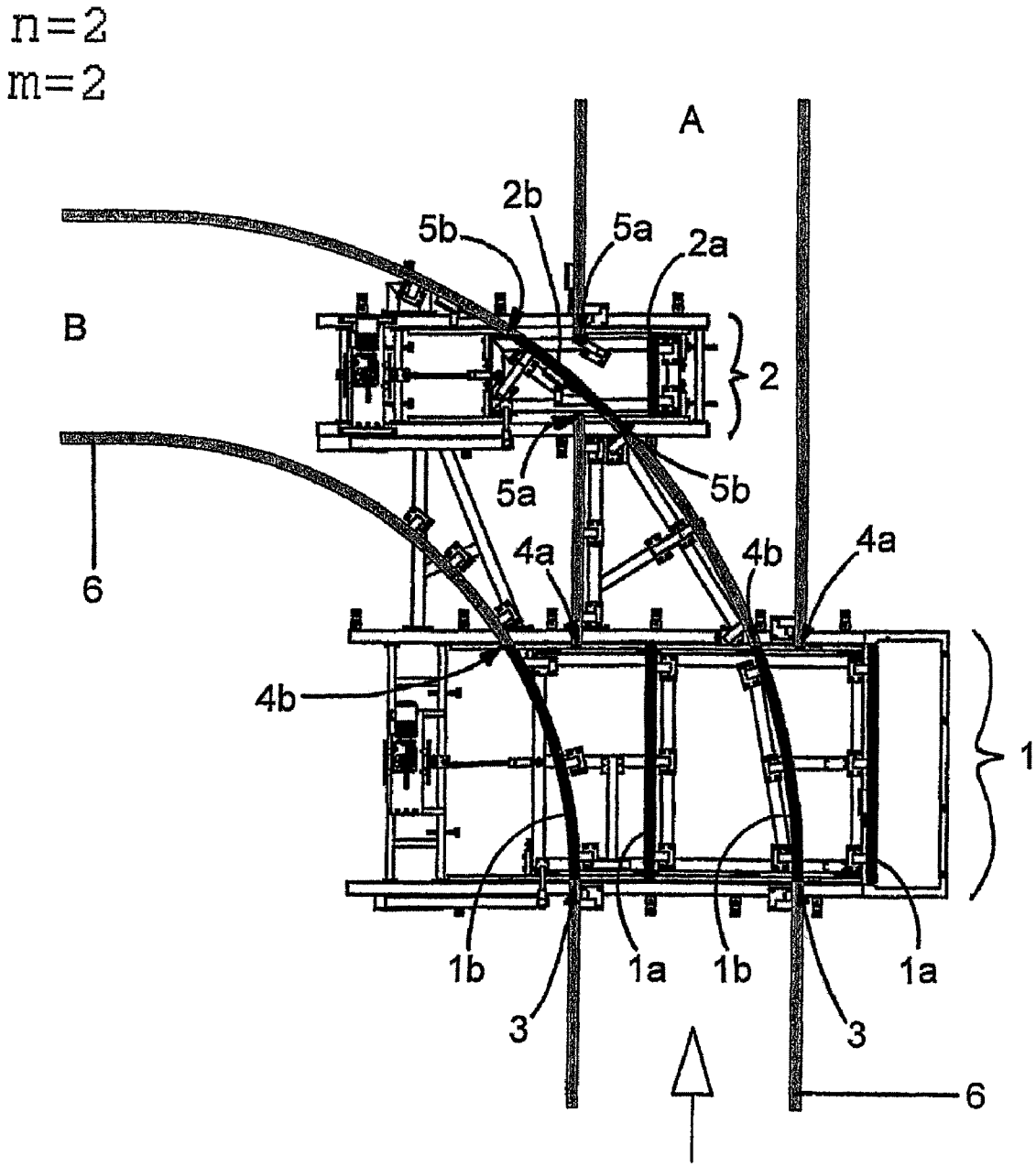
FIG. 2 shows a plan projection of the rail system shown in FIG. 1, which is instead set up with the first and second actuating means positioned so as to allow a vehicle to travel along an electric cable means provided along at least one of the parallel rail means defining the pathway B, taken along line 4 of FIG. 3.

A plan projection of the specific embodiment shown in FIG. 1 is shown in FIG. 2. In this figure, the rail system is set up to allow for a vehicle to convey a pallet along the travel pathway B. Travel pathway A is not amendable to conveying a pallet, since the joining points (3) and continuation points (4*a*) are not linked by the rigid rail portions (1*a*) of the first actuating means (1). Furthermore, the rail ends optionally holding cable ends at the crossing portions (5*a*) are not linked by rigid rail portions (2*a*) of the second actuating means (2). Therefore a travel pathway allowing the vehicle to continuously travel across the switch along the electric cable means 100 (see FIG. 3) provided on at least one of n parallel rail means (6) defining the travel pathway A is not provided in the setup shown in FIG. 2.

Figure 3:
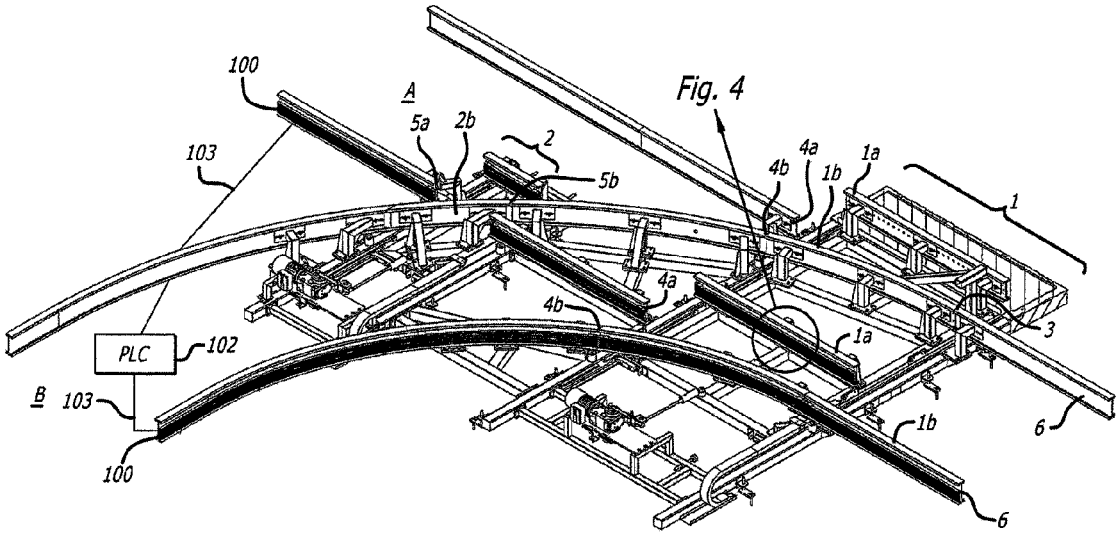
FIG. 3 shows an orthographic projection of the rail system shown in FIG. 1, which is instead set up with the rigid rail portions of the first actuating means selectively defining the pathway B, except that the second actuating means has not been switched to allow a vehicle to travel through the crossing point and further along the pathway B taken along line 4 of FIG. 3.

An orthographic projection of the specific embodiment of FIG. 1 is shown in FIG. 3. In this figure, the rail system is set up such that selectively positioning the rigid rail portions (1*a*) of the first actuating means (1) so as to link the joining points (3) and the continuation points (4*a*) would provide a travel pathway A allowing the vehicle to continuously travel across the switch along the electric cable means 100 provided on at least one of the n parallel rail means (6) defining said travel pathway. Alternatively, selective positioning of the rigid rail portions (2*b*) of the second actuating means (2) so as to link the rail ends optionally holding cable ends at the crossing portions (5*b*) would provide a travel pathway B allowing the vehicle to continuously travel across the switch along the electric cable means 100 provided on at least one of n parallel rail means (6) defining said travel pathway. Thus, as seen in FIG. 3, an electric cable means 100 in the form of an electronically conductive wire, or a solid wire or woven strands, is provided on at least one of the parallel rail means defining a travel pathway. The electric cable means 100 are capable of carrying electric current. Such electric current may be used to either relay information or provide energy for powering the conveyor. Cable means 100 is electronically coupled to the programmable logic controller (PLC) 102 through suitable electronic conduits 103.

Figure 4:
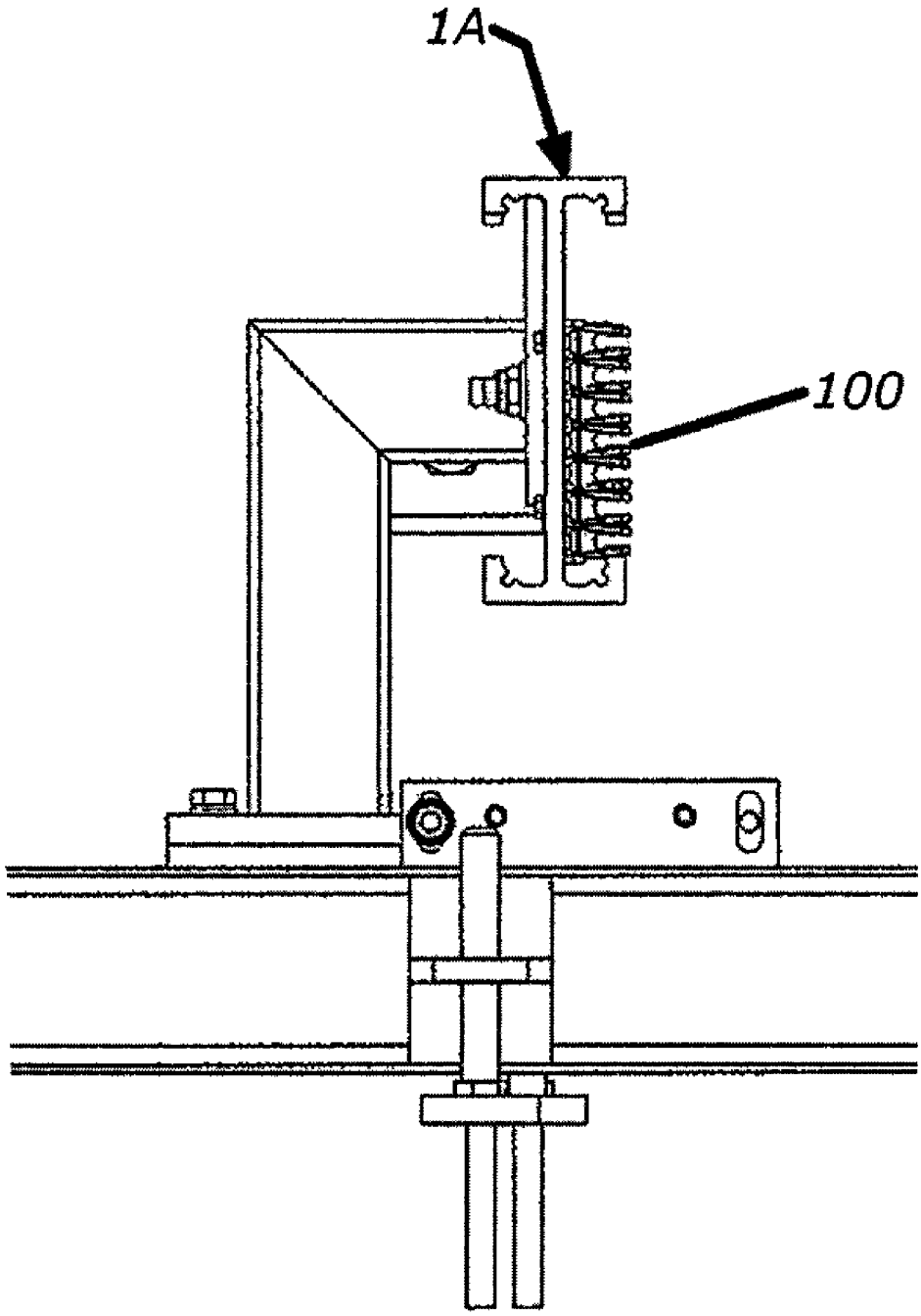
FIG. 4 is a partial cross-sectional view of a rail means in accordance with the teachings of the invention.

FIG. 4 shows a partial cross sectional view of one of the rail means of FIG. 3. Accordingly, a rigid rail portion 1*a*, of the switch means is shown which is provided with cable means 100. The cable means 100 comprise multiple cables including cables for powering the conveyor, for controlling the movement of the conveyor and for determining the position of the conveyor. In the embodiment of FIG. 4, the cable means 100 comprises seven cables. Preferably, in case of n parallel rail means defining a pathway, only a single rail means of the n parallel means of the pathway is provided with cable means. The cable means 100 are adapted to cooperate with a pickup unit (not shown) provided on a vehicle. Accordingly, the vehicle may establish a permanent and stable contact with the cable means. The cables of the cable means 100 may be connected to PLC 102 (FIG. 3). The PLC electronically controls how individual section of the rail system interact with the vehicle, and, hence, pallet, being conveyed. The PLC may also control the positioning of the first and second actuating means in relation to the vehicle. Furthermore, the PLC may control the movement and positioning of the vehicle in relation to the rail system. Some of the cables of the cable means 100 may be connected to a power supply for powering the vehicle. The connection of the power supply to the cable means 100 may be provided at multiple positions along a cable so as to provide a contact of the vehicle to the power supply at any position of the switch means.

The present invention also provides a process for operating a switch of a rail system for a powered pallet conveyor according to the invention. The process comprises the steps of (a) selecting one of n alternative pathways;

(b) positioning n rigid rail portions for bridging the distance between (i) n joining points where the m alternative travel paths subject to switching coincide, and (ii) n continuation points of the selected travel path downstream from the joining points, (c) positioning n−1 rigid rail portions for bridging the distance between rail ends optionally holding cable ends at crossing portions where each alternative pathway subject to switching is discontinued downstream from the corresponding continuation points.

Each step in the process of operating a switch of a rail system for a powered pallet conveyor may be performed either manually by a human controller and/or automatically by an automated controller such as a PLC, respectively. Each step in the process may be timed to coincide with the steps of many other identical processes in order to maximize the overall efficiency with respect to time or cost of conveying multiple pallets along a pathway comprised of multiple travel pathways. An example of such a pathway is that of a powered pallet conveyor used in sorting and distributing pallets in, for example, line shaft production. Accordingly, the rail system of the present invention is suitable for use in the automobile, food, agricultural, pharmaceutical, electronic, chemical or print industries.

Selecting one of n alternative pathways is performed prior to the vehicle traveling across the switch, depending on the direction in which the pallet, and hence vehicle, need be conveyed. Selection of a pathway may be made by the controller depending on, for example, the type of load which the vehicle and/or pallet is carrying.

Subsequent to selecting one of n alternative pathways the controller establishes whether the rail system is set up such that a vehicle can cross the switch and travel along the chosen pathway. In the event that the vehicle can cross the switch and travel along the selected pathway, repositioning of the rail system is unnecessary and the rail system remains unchanged. In the event that the rail system is set up such that a vehicle cannot cross the switch and, therefore, is unable to travel along the selected pathway, repositioning of the rigid rail portions of either or both of the first and second actuating means is required. The repositioning of the rigid rail portions of the first actuating means may be performed independently of the repositioning of the rigid rail portions of the second actuating means.

Repositioning of the rigid rail portions of the first actuating means is effected by the controller sending an electronic signal to the mechanism driving the actuating means. The mechanism repositions the first actuating means so as to ensure that a subset of n of the (m*n) rigid rail portions bridge the distance between n joining points and a subset of n of the (m*n) continuation points which are located on the parallel rail means of the selected travel pathway. This allows the vehicle to subsequently cross the switch and travel along the selected pathway.

Repositioning of the rigid rail portions of the second actuating means is effected by the controller sending an electronic signal to the mechanism driving the actuating means. The mechanism repositions the first actuating means so as to ensure that a subset of (n−1) of the [m(n−1)] rigid rail portions bridge the distance between the rail ends optionally holding cable ends at a subset of 2(n−1) of the rail ends at the crossing portions and thereby allow the vehicle to cross the switch and travel along the selected pathway.

The spatial relationship between the joining points, continuation points and crossing points is described as follows. The joining points are defined by the locations where the m alternative travel paths subject to switching coincide or diverge. The continuation points are located downstream from the joining points along the selected travel path. Specifically, the continuation points are located on the first actuating means at positions distant from the n joining points along each of the alternative travel pathways subject to switching. Furthermore, the crossing points are located at positions distant from the rigid rail portions of the first actuating means along each of the alternative travel pathways subject to switching.

The process for operating the switch of the rail system thereby provides the selected pathway allowing the vehicle to travel along an electric cable means provided along at least one of n parallel rail means defining the selected pathway.

Although specific embodiments of the invention are disclosed, variations thereof may occur to an artisan, and the scope of the invention should only be limited by the scope of the appended claims.

The invention claimed is:

1. Powered pallet conveyor comprising a vehicle a rail system, said rail system comprising alternative pathways for the vehicle traveling along an electric cable means provided on at least one of n parallel rail means defining a travel pathway, wherein n≧2, whereby the rail system comprises a switch means for switching between m alternative travel pathways, wherein m≧2, and allowing the vehicle to continuously move across the switch after switching, said switch means comprising (a) a first actuating means for selectively positioning (m*n) rigid rail portions bridging the distance between rail ends optionally holding cable ends at (i) n joining points where the two parallel rail means of each of the m alternative travel pathways subject to switching converge, and (ii) (m*n) continuation points where each alternative pathway subject to switching diverges downstream from the joining points, and (b) a second actuating means for selectively positioning [m(n−1] rigid rail portions bridging the distance between rail ends where each alternative pathway subject to switching is discontinued downstream from the corresponding continuation points, and whereby the rail system further comprises a programmable logic controller (PLC) controlling the positioning of the first and second actuating means in relation to the vehicle as well as the movement and positioning of the vehicle in relation to the rail system, whereby the positioning of a set of n rigid portions by the first actuating means and the positioning of (n−1) rigid rail portions by the second actuating means provides a travel pathway allowing the vehicle to continuously travel across the switch along the electric cable means provided on at least one of the n parallel rail means defining the travel pathway allowing the vehicle to continuously travel across the switch along the electric cable means provided on at least one of n parallel rail means defining the travel pathway.

2. A process for operating a switch of a rail system for a powered pallet conveyor as defined by claim 1, which comprises the steps of:

(a) selecting one of n alternative pathways;

(b) positioning n rigid rail portions for bridging the distance between:

(i) n joining points where the m alternative travel pathways subject to switching coincide, and (ii) n continuation points of the selected travel pathway downstream from the joining points; and (c) positioning n−1 rigid rail portions for bridging the distance between rail ends where each alternative pathway subject to switching is discontinued downstream from the corresponding continuation points;

thereby providing the selected pathway allowing the vehicle to travel along an electric cable provided along at least one of the n parallel rails defining the selected pathway.

3. The conveyor according to claim 1, wherein n is 2.

4. The conveyor according to either claim 1 or 2, wherein m is 2.

5. The conveyor according to claim 1, wherein the first actuating means is a shifting frame.

6. The conveyor according to claim 1 or 2, wherein the second actuating means is a shifting frame.

7. The conveyor according to claim 1, or 2, wherein the pathways are mounted on a floor.

8. The conveyor according to claim 1 or 2, further comprising said rail system including position determining means for determining the position of a vehicle on said rail system and communicating the position to a control.

* * * * *